United States Patent [19]

Ashby

[11] Patent Number: 5,039,000

[45] Date of Patent: Aug. 13, 1991

[54] MAILER WITH TEAR STRIP ON OUTGOING AND RETURN ENVELOPES

[75] Inventor: Robert E. Ashby, Quakertown, Pa.

[73] Assignee: Moore Business Forms, Inc., Grand Island, N.Y.

[21] Appl. No.: 633,150

[22] Filed: Dec. 24, 1990

Related U.S. Application Data

[63] Continuation-in-part of Ser. No. 482,868, Feb. 22, 1990.

[51] Int. Cl.[5] ..... B65D 27/06

[52] U.S. Cl. ..... 229/73; 229/69

[58] Field of Search ..... 229/69, 73; 206/610

[56] References Cited

U.S. PATENT DOCUMENTS

| | | | |
|---|---|---|---|
| 2,264,233 | 12/1960 | McFarland | 229/73 |
| 3,529,756 | 9/1970 | Smith | 225/99 |
| 3,837,565 | 9/1974 | Johnsen | 229/73 |
| 3,863,835 | 2/1975 | Gendron | 229/73 |
| 3,905,545 | 9/1975 | Juszak et al. | 229/69 |
| 3,955,750 | 5/1976 | Huffman | 229/69 |
| 3,982,689 | 9/1976 | Retrum | 229/71 |
| 3,988,971 | 11/1976 | Steidinger | 93/63 |
| 4,002,290 | 1/1977 | Van Malderghem | 229/69 |
| 4,055,294 | 10/1977 | Traise | 229/69 |
| 4,081,127 | 3/1978 | Steidinger | 229/69 |
| 4,102,489 | 7/1978 | Lucas | 229/73 |
| 4,418,865 | 12/1983 | Bowen | 229/69 |
| 4,437,852 | 3/1984 | Voll, Jr. et al. | 493/216 |
| 4,543,082 | 9/1985 | Stenner | 493/216 |
| 4,586,611 | 5/1986 | Scalzo | 229/69 |
| 4,632,427 | 12/1986 | Angus | 282/11.5 |
| 4,671,454 | 6/1987 | Warren | 206/610 |
| 4,715,530 | 12/1987 | Leese et al. | 229/73 |
| 4,756,468 | 7/1988 | Jenkins | 229/73 |
| 4,775,094 | 10/1988 | Eisele | 329/69 |
| 4,779,792 | 10/1988 | Lombardo | 229/73 |
| 4,819,807 | 4/1989 | Giger | 206/610 |
| 4,830,269 | 5/1989 | Jenkins | 229/73 |
| 4,840,306 | 6/1989 | Lombardo | 229/73 |
| 4,896,823 | 1/1990 | Taylor | 229/73 |
| 4,934,536 | 6/1990 | Mills | 206/610 |
| 4,955,526 | 9/1990 | Haase et al. | 229/69 |

*Primary Examiner*—Gary E. Elkins

*Attorney, Agent, or Firm*—Nixon & Vanderhye

[57] ABSTRACT

A mailer type business form is provided which includes an outgoing envelope formed by a first sheet folded along a fold line to provide first and second panels each having three marginal edge portions, and a return envelope formed by a second sheet overlying the second panel and adhesively secured to the second panel inwardly adjacent the three marginal edge portions such that the second panel forms a rear panel of both the outgoing envelope and the return envelope. A removable tear strip is incorporated in the second panel and is defined by a slit formed in the second panel parallel to and adjacent one of the marginal edge portions, and a pair of parallel lines of perforations extending perpendicularly from opposite ends of the slit toward the fold line.

20 Claims, 5 Drawing Sheets

FIG. 2
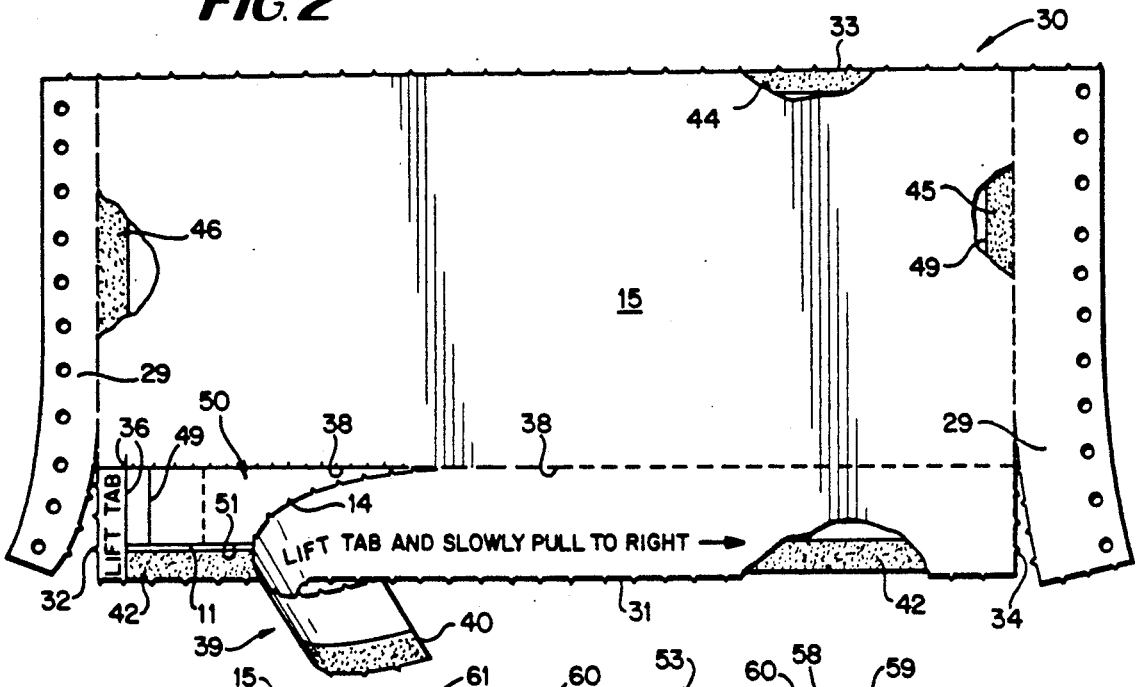
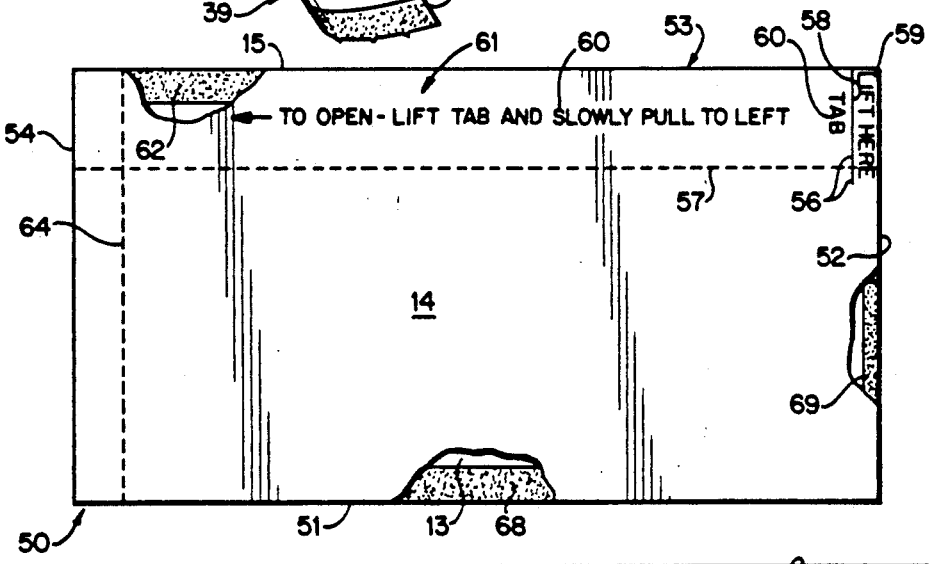
FIG. 3
FIG. 4
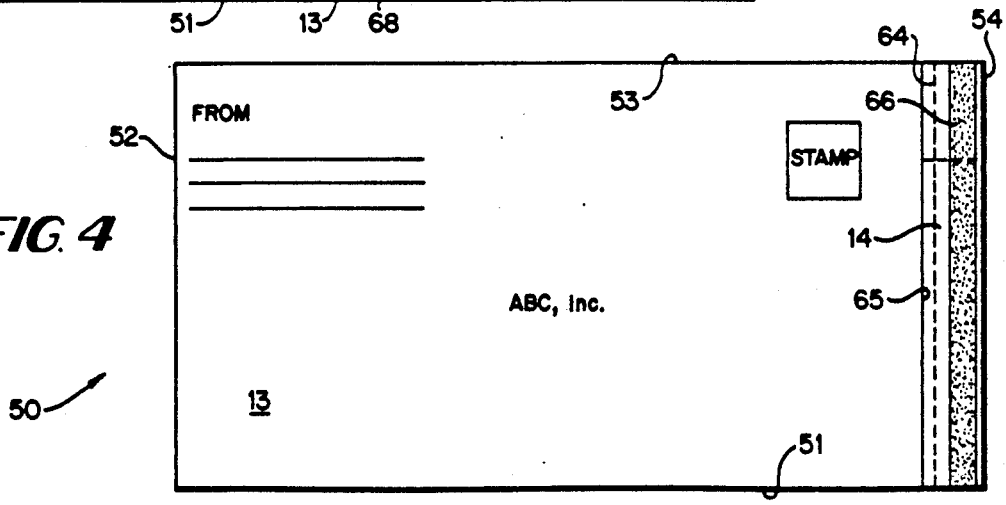

FIG. 6
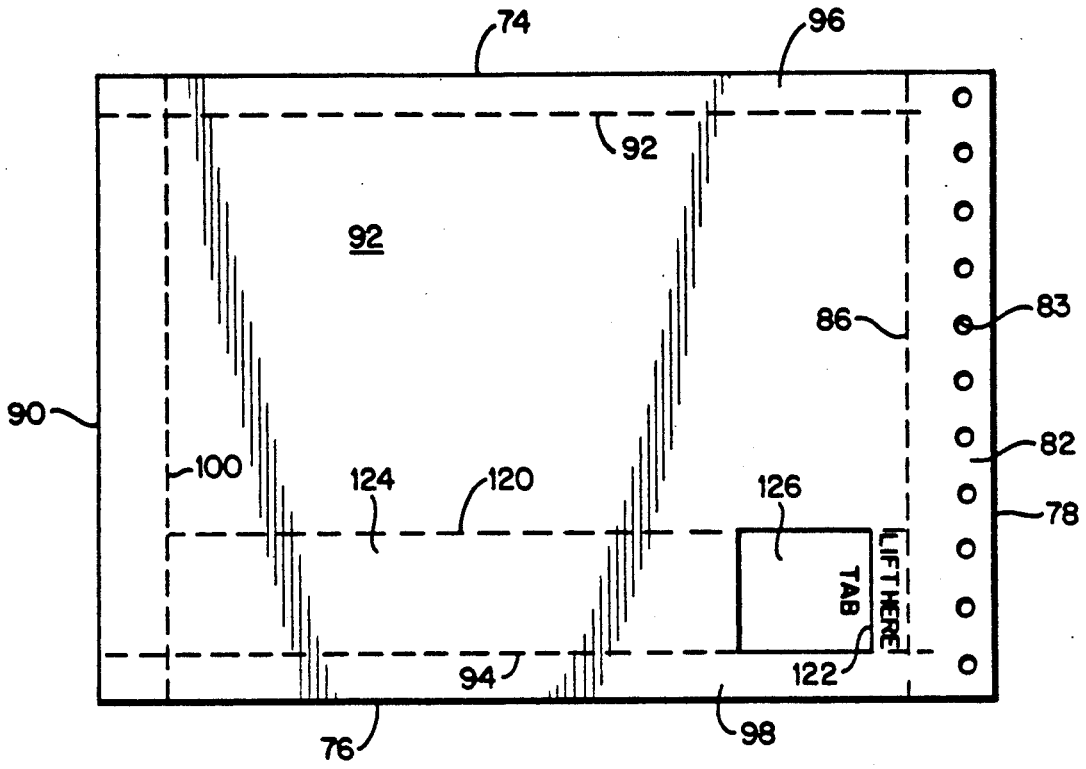
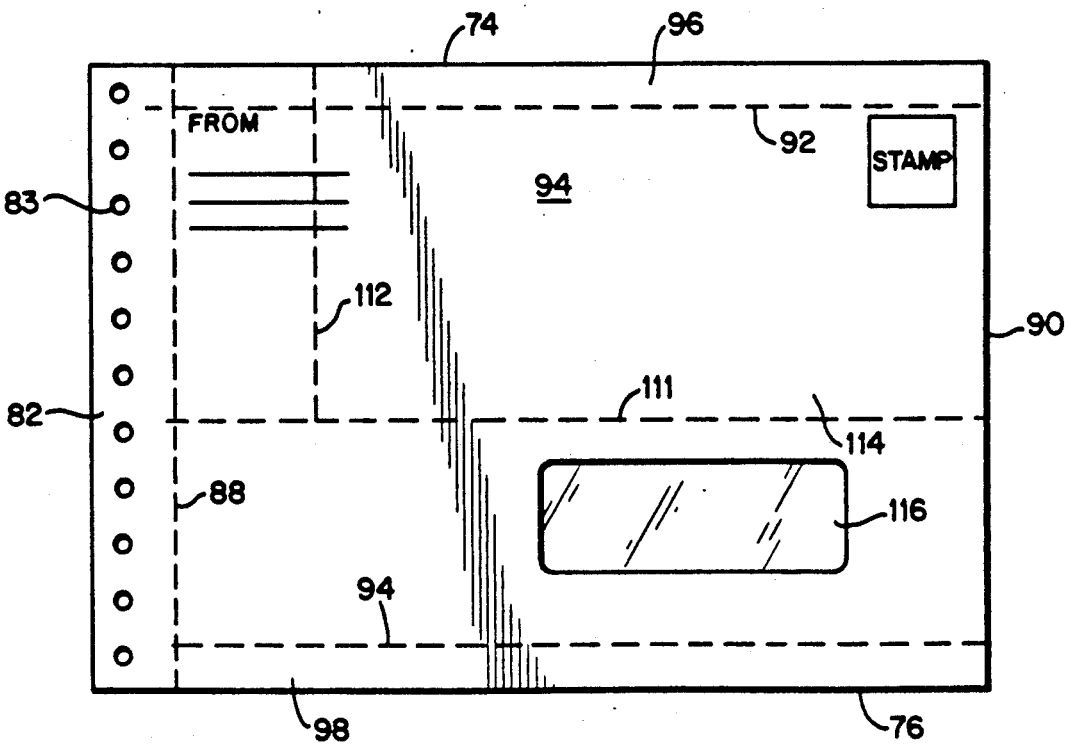
FIG. 7

MAILER WITH TEAR STRIP ON OUTGOING AND RETURN ENVELOPES

RELATED APPLICATIONS

This application is a continuation-in-part of application Ser. No. 07/482,868, filed Feb. 22, 1990, pending.

BACKGROUND AND SUMMARY OF THE INVENTION

A particularly desirable form of conventional mailer includes a tear strip feature on the outgoing envelope. One particular form of this type of mailer is a ZIP STRIP® mailer such as sold by Moore Business Forms, Inc. of Glenview, Ill. While such a feature is desirable, the return envelope typically does not have an easy opening feature associated therewith. Typically when the addressor of the outgoing envelope receives the return envelopes back, they are opened in such a way that damage to the contents thereof may occur. Normally, a mechanical letter opener is used to access the return envelope, slitting open one edge, again with possible damage to the contents.

According to the present invention, a mailer construction is provided, and a method of continuously making such mailers, wherein the return envelope is also provided with a tear strip. This allows the addressor of the outgoing envelope to also easily access the contents of the envelope returned to it by the addressee of the outgoing envelope, efficient manual removal of the contents of the return envelope without significant possibility for damaging the contents thereof being possible.

According to one aspect of the present invention, a method of continuously constructing mailer type business forms is provided. The method comprises the steps of: (a) Providing first and second sheets of an outgoing envelope, each sheet having first, second, third and fourth edges. (b) Providing first and second sheets for a return envelope, each having first, second, third and fourth edges. (c) Forming a slit in the first sheet parallel to the second edge thereof, and intersecting the first edge thereof, and a perforation adjacent and parallel to the first edge, and intersecting the slit, in each of the outgoing and return envelopes, to provide an easy opening tear strip. (d) Applying adhesive connecting the first and second sheets of the outgoing envelope together at edges thereof, to form an outgoing envelope. And, (e) applying adhesive connecting the first and second sheets of the return envelope together at three edges thereof, leaving one open edge to allow access to the interior of the return envelope. Typically step (c) is practiced by providing the perforation of the tear strip perpendicular to the open edge of the return envelope, and in the bottom sheet of the return envelope, address information being provided on the top sheet of the return envelope. Also the bottom sheet of the return envelope typically is wider than the top sheet of the return envelope, overlapping at the fourth edge thereof, and having adhesive applied to the overlapping portion so that it can be bent back over and adhesively secured to the top sheet of the return envelope.

It is desirable to provide the tear strips in the outgoing and return envelopes parallel to each other, both in the bottom sheets of the respective outgoing and return envelopes. It is also desirable to provide an insert between the top sheet of the outgoing envelope and the top sheet of the return envelope, the insert not being adhesively secured to either envelope. The insert may have an edge portion which is adhesively secured to the outgoing envelope, but there is a die cut or perforation between the edge portion of the insert and the insert so that the insert may be readily removed from the outgoing envelope.

According to another aspect of the present invention a mailer type business form is provided. The business form comprises: An outgoing envelope comprising first and second sheets, each sheet having first, second, third and fourth edges, an adhesive securing the first and second sheets together at edges thereof. A slit formed parallel to and adjacent the second edge and intersecting the first edge, and a perforation disposed adjacent and parallel to the first edge and intersecting the slit, the perforation extending from the slit to essentially the fourth edge, both the slit and perforation being formed in the first sheet of the outgoing envelope to provide an easily openable tear strip. A return envelope disposed within the outgoing envelope, the return envelope formed from first and second sheets each having first through fourth edges, with adhesive attaching three of the edges together but leaving a fourth edge open to allow access to the interior of the return envelope. And, a slit formed parallel to and adjacent the second edge and intersecting the first edge, and a perforation disposed adjacent and parallel to the first edge and intersecting the slit, the perforation extending from the slit to essentially the fourth edge, both the slit and perforation being formed in the first sheet of the return envelope to provide an easily openable tear strip.

In this continuation-in-part application, additional embodiments of the invention are disclosed which incorporate tear strips for facilitating the opening of the return envelope by the original addressor, upon receiving the return envelope from the addressee. In these additional embodiments, a single sheet is utilized to form the first and second panels of the outgoing envelope, while at the same time, the rear panel of the outgoing envelope also serves as the rear panel of the return envelope.

Thus, the newly added embodiments of this invention provide a mailer business form comprising, in their broader aspects, an outgoing envelope comprising a first sheet folded along a fold line to form first and second panels each having three marginal edge portions, a return envelope comprising a second sheet overlying the second panel and adhesively secured to the second panel inwardly adjacent the three marginal edge portions such that the second panel forms a rear panel of both the outgoing envelope and then return envelope; a slit formed in the second panel parallel to and adjacent one of the marginal edge portions, and a pair of parallel lines of perforations extending perpendicularly from opposite ends of the slit toward the fold line so as to provide an easily openable tear strip in the rear panel to facilitate access to the interior of the return envelope.

It is the principal object of this invention to provide mailer type business forms with tear strips to facilitate opening of the outgoing and/or return envelopes. Other objects of the invention will become clear from an inspection of the detailed description of the invention and from the appended claims.

BRIEF DESCRIPTION OF THE DRAWINGS

FIG. 2 is a bottom plan view, with portions cut away for clarity of illustration, of a typical mailer type business form produced utilizing the apparatus of FIG. 1;

FIG. 3 is a bottom plan view, with portions cut away, of the return envelope of the business form of FIG. 2;

FIG. 4 is a top plan view of the return envelope of FIG. 3;

FIG. 6 is a bottom plan view of the business form illustrated in FIG. 5, but in a folded construction, and ready for mailing;

FIG. 7 is a top plan view of the business form illustrated in FIG. 5, but in a folded condition and ready for mailing.

DETAILED DESCRIPTION OF THE DRAWINGS

Figure 1:
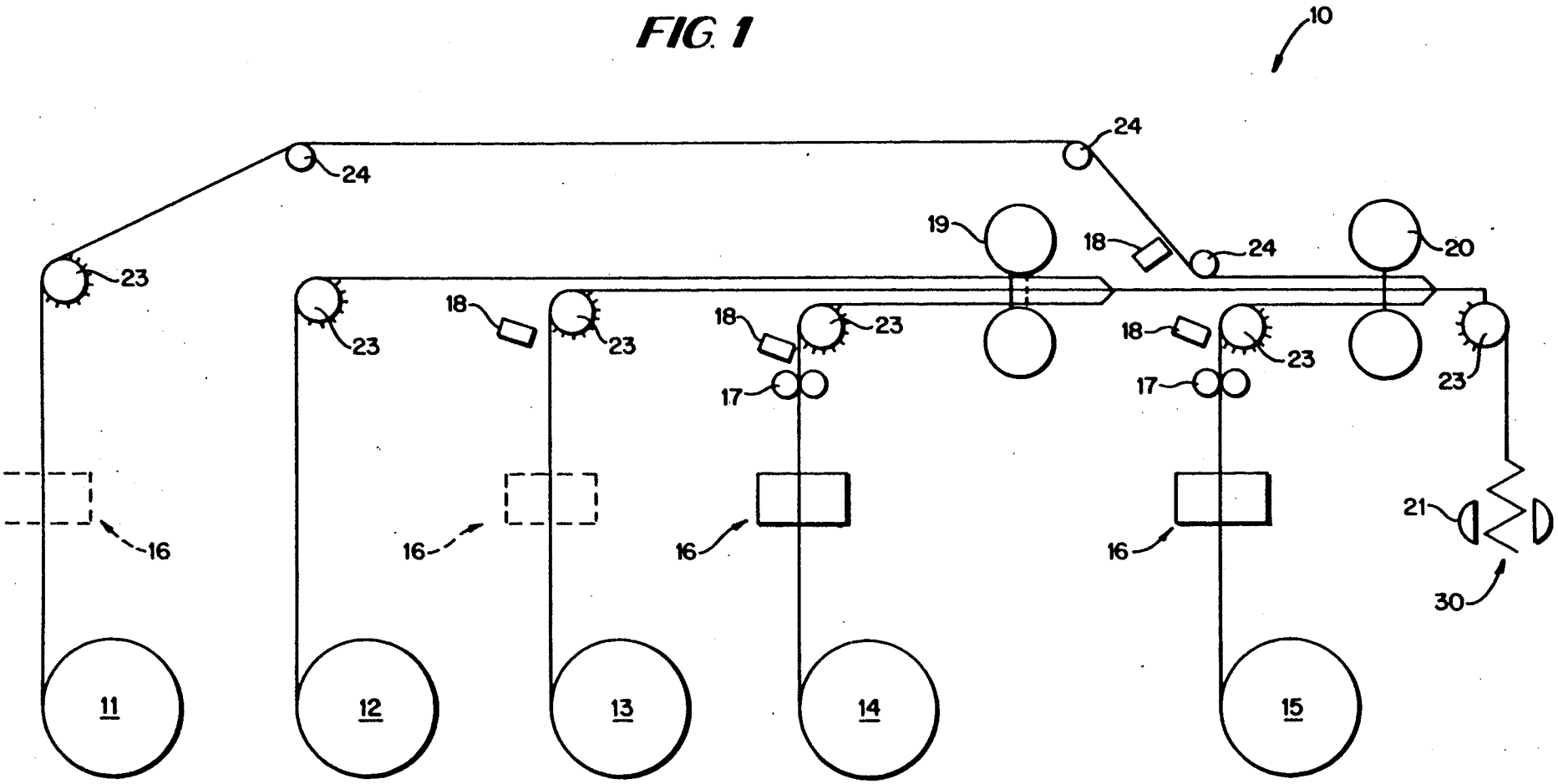
FIG. 1 is a schematic view of apparatus utilized to construct mailer type business forms according to the method of the present invention.

The apparatus 10 illustrated in FIG. 1 is utilized in the method of continuously producing mailer type business forms according to the invention, which provide easy opening tear strips in both the outgoing and return envelopes. A roll 11 provides a second sheet for the outgoing envelope, roll 12 provides an insert, roll 13 provides a second sheet of the return envelope, roll 14 a first sheet of the return envelope, and roll 15 a first sheet of the outgoing envelope. Conventional slit and perf units 16 are provided for forming the tear strips in various sheets of the business form being constructed. As illustrated in FIG. 1, the units 16 are provided for forming the slits and perfs for the tear strip in the first sheets of both of the outgoing and return envelopes. However as illustrated in dotted line in FIG. 1, a unit 16 may be provided associated with the sheets 11, 13 instead of the sheets 14, 15; or may be associated with the sheets 11, 14, or 13, 15, depending upon the particular mailer being constructed.

The apparatus 10 further comprises conventional pattern pasting units 17 for the outgoing and return envelopes, and conventional vertical pasting units 18. The units 17, 18 apply adhesive at various portions of the continuous sheets 11, 13, 14, and/or 15 so that the outgoing envelope is connected together at all four edges thereof, and the return envelope at three of the four edges thereof. A conventional die cut chip unit 19 is provided associated with the sheets 12 through 14, so as to make the return envelope and insert readily removable from the outgoing envelope. After all of the sheets 11 through 15 have been laid together, a conventional cross perforating unit 20 forms each of the integral elements being constructed into a separate mailer, passing to the folder 21 where they are typically folded for ease of packaging and transport.

Located at various portions within the apparatus 10 are toothed wheels 23 and rollers 24. The toothed wheels 23 typically engage tractor drive portions of the sheets 11 through 15, which tractor drive portions will ultimately subsequently be removed. Regardless, the units 23 and the rollers 24 merely guide the sheets into proper juxtaposition with respect to each other during manufacture.

One of the typical mailer type business forms 30 according to the present invention is illustrated in FIG. 2. The business form 30 has tractor drive edge portions 29 thereof that are connected by perforations to the main body of the mailer, but are removed prior to use—that is prior to actual mailing of the outgoing envelope. The tractor drive portion strips 29 were provided to facilitate construction utilizing the apparatus 10, and also to allow the addressor of the outgoing envelopes to print whatever information is desired on the outgoing envelope, and typically on the insert and return envelope too, utilizing various types of carbon spots, carbonless coatings, or the like on the various sheets. The exact manner of providing carbon spots, carbonless coatings, and the like are conventional, and will depend upon the particular use to which the addressor seeks to put the form 30.

The sheet 15 of the form 30 (as the sheet 11) has a first edge 31, second edge 32, third edge 33, and fourth edge 34, consecutively disposed along its periphery. At the edges 32, 34 perforations are provided to allow ready detachment of the tractor drive strips 29. The top and bottom edges 31, 33 of the form 30 were produced by the perforating unit 20, and originally were connected to other mailers in a continuous strip, but are readily detached at the perforations formed at the edges 31, 33.

An easy opening tear strip feature is provided in the outgoing envelope formed by the sheets 11, 15. As illustrated in FIG. 2, the sheet 15 is shown as the bottom sheet, while the sheet 11 (not shown in FIG. 2) has address information on the outside thereof. However the reverse could also be the case. In the embodiment illustrated in FIG. 2, a slit 36 is formed parallel to and adjacent the second edge 32, and intersecting the first edge 31. A perforation 38 is disposed adjacent the first edge 31, and spaced therefrom and parallel thereto, intersecting the slit 36 and extending all the way to, and preferably intersecting, the fourth edge 34. This slit 36 and perforation 38 arrangement provides a tear strip 39, which has an edge 40 originally defined by the slit 36 that can be grasped by the user and pulled to the right as viewed in FIG. 2, causing the strip 39 to detach at the perforation 38 from the sheet 15.

As can be seen in FIG. 2, the outgoing envelope preferably has the sheets 11, 15 adhesively connected together at all four edges thereof. For example adjacent the edge 31 adhesive strip 42 connects the sheets 15, 11, and like strips 44, 45, 46 connect the sheets 15, 11 together adjacent the second through fourth edges respectively thereof. The adhesive connection 42 is not substantial, merely being a pattern adhesive type arrangement, so that the tear strip 39 may readily be detached from the top sheet 11. All parts are preferably pasted together. For example, at least the three parts (including the insert 12) are pasted to the outgoing envelope at the left and right.

Disposed within the outgoing envelope 11, 15 of the business form 30 is the return envelope 50, connected to the outgoing envelope but readily detachable therefrom, and the insert 12.

The return envelope 50, as most clearly seen in FIGS. 3 and 4, has first, second, third, and fourth edges 51 through 54, respectively, of the second sheet 14 thereof, which preferably is the bottom sheet, the top sheet 13 having address information formed thereon as seen in FIG. 4. Adjacent to the second edge 52 and parallel thereto, and intersecting the third edge 53, is the slit 56 comparable to the slit 36 in the outgoing envelope. The perforation 57 is spaced from and parallel to the third edge 53 and preferably intersects the perforation 64, being comparable to the perforation 38 in the outgoing envelope. Thus a readily detachable tear strip 61 is provided, such as the feature sold under the trademark "ZIP STRIP®" by Moore Business Forms, Inc. of Glenview, Ill. Note that the edge 58 of the tear strip 61 is formed at the slit 56 and may be grasped to allow the strip 61 to be detached by a leftward movement (as viewed in FIG. 3). Also, indicia may be provided, such as the indicia 59 indicating "lift", and the indicia 60 indicating "tab" and directions for pulling the tab to detach the tear strip 61.

For the return envelope 50, adhesive 62, 68, 69 is provided connecting three of the four edges of the bottom sheet 14 and top sheet 13 together. The adhesive 62 is preferably a patterned adhesive to allow ready detachment of the tear strip 61 from the top sheet 13 when the tear strip 61 is removed.

The return envelope 50 also preferably is constructed so that the bottom sheet 14 is wider than the top sheet 13. The top sheet 13 has the fourth edge 65 thereof inwardly spaced from the fourth edge 54 of the bottom sheet 14. Preferably a perforation 64 is provided at the overlapping portion of the bottom sheet 14, and wettable adhesive 66 or the like is provided on the overlapping portion so that it may be bent over at the perforation 64 and adhesive 66 brought into contact with the top sheet 13 thereby adhesively securing the return envelope 50 after the check, or other paper, is inserted into the open end (at the fourth edges 54, 65) of the return envelope 50. Note that at the second edge 52 adhesive 69 connects the sheets 13, 14 together while at the first edge 51 and third edge 53 the adhesive 68 and 62 connects the sheets 13, 14 together.

The mailer 30 according to the present invention is easy to construct and utilize. When the outgoing envelope formed by the sheets 15, 11 is mailed out, the addressee—to gain access thereto—merely grabs the edge portion 40 of the tear strip 39, and pulls rightwardly (in FIG. 2) exposing the return envelope 50 and the insert 12. The insert 12 and return envelope 50 are readily removed from the interior of the outgoing envelope [they need not be adhesively secured thereto, but may be secured thereto by a die cut or perforations 49]. After the addressee inserts whatever documents or things need be inserted into the open end at the fourth edge 54, 65 of the return envelope 50, the overlapping portion at the fourth edge is folded at perforation 64 and adhesively secured by adhesive 66 to the top sheet 13 of the return envelope 50. The return envelope 50 is then mailed back to the original addressor by the original addressee.

When the original addressor receives the return envelope 50 the contents thereof are readily manually removed merely by an operator grabbing the tab edge 58 and pulling to the left (as illustrated in FIG. 3), detaching the tear strip 61 from the bottom sheet 14 of the return envelope 50. This exposes the interior contents of the envelope 50 without the possibility of damage to the interior components thereof, allowing quick and effective removal thereof.

The tear strip feature may be positioned adjacent either first edge 31 or third edge 33 on sheet 11 or 15 of the outgoing envelope and can be "pulled" to the left or the right. This feature also may be positioned adjacent first sheet edge 51 or third sheet edge 53 on sheet 13 or 14 of the return envelope and can be "pulled" to left or right. Other forms specifications will dictate in which position the tear strip feature will be located.

In this continuation-in-part application, variations of the above described mailer are disclosed. In these variations, a single sheet is utilized to form the first and second (or front and rear) panels of the outgoing envelope, the rear panel of the outgoing envelope also serving as the rear panel of the return envelope, and the tear strip is provided in the rear panel to facilitate opening of the return envelope by the original addressor, upon receiving the return envelope from the addressee.

Figure 5:
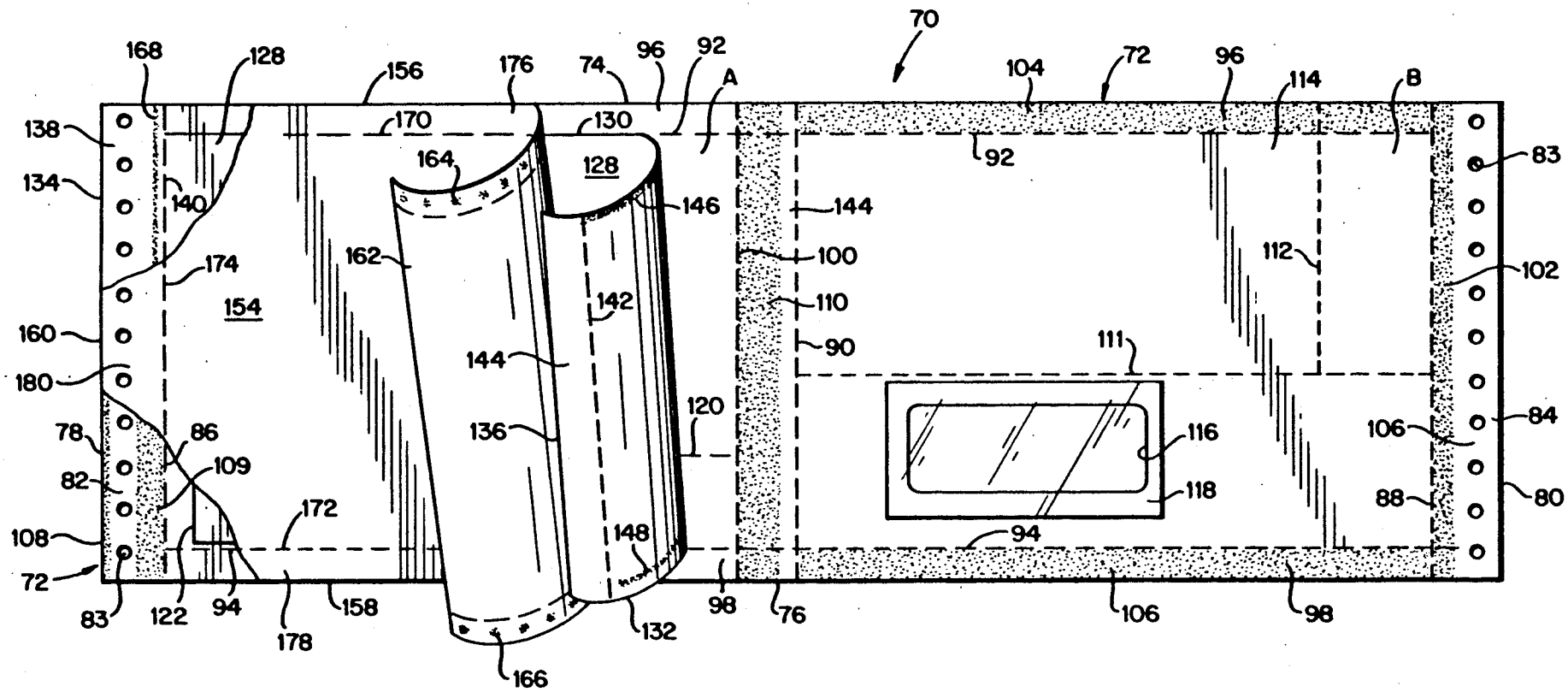
FIG. 5 is a top plan view of an unfolded business form in accordance with an alternative embodiment of the invention, with portions cut away for clarity.

Referring to FIGS. 5 through 7, the form 70 comprises an elongated first sheet 72 having (relative to the orientation of the form in FIG. 5) an upper edge 74, a lower edge 76, and a pair of side edges 78, 80. Tractor drive strips 82, 84 formed with a plurality of drive pin engaging holes 83 are provided along the longitudinal marginal edges of the sheet 72 (along with similar tractor drive strips on additional sheets of the form as described below) to facilitate feeding of the form during assembly. The tractor drive strips 82, 84 are defined by longitudinal marginal perforation lines 86, 88 and the longitudinal side edges 78, 80. The reference to "longitudinal" lines and edges relates to the manufacture of the forms from a continuous, longitudinal web traveling in a direction parallel to the orientation of feed holes 83, as generally shown in FIG. 1. Thus, edges 74, 76 may also be referred to as "transverse" edges. It will be appreciated that individual form assemblies are connected to each other during manufacture by transverse perforations along, for example, edges 74, 76 so as to permit easy separation.

The sheet 72 is bifurcated by a centrally located perforation or fold line 90 extending parallel to the marginal perforation lines 86, 88. Sheet 72 is thus divided by fold line 90 so as to form a rear panel A and a front panel B of the outgoing envelope.

Transverse lines of perforations 92, 94 extend along and adjacent the upper and lower edges 74, 76, respectively, to form removable transverse marginal edge strips 96, 98 extending completely across panels A and B. A longitudinal perforation line 100 extends parallel to the fold line 90 between transverse edges 74, 76 for a purpose described below.

In addition to the above described perforation lines, sheet 72 is provided on its inner face, i.e., that side facing the interior of the form, with adhesive lines 102, 104 and 106 on the front panel B, which may comprise heat activated adhesive, conventionally used in the production of business forms. An additional line 108 of adhesive of the pressure sensitive or heat activated type is provided along the marginal edge 78 of tractor drive strip 82, and a further heat activated adhesive strip 109, similar to lines 102, 104 and 106, is applied along the perforation line 86, and within the tractor drive strip 82. Another adhesive strip 110, preferably rewettable adhesive, is applied along the perforation line 100, extending between transverse edges 74, 76.

Referring again to the front panel B, a perforation line 111 extends parallel to, and about midway between, perforation lines 92, 94 from the longitudinal perforation line 88 to the longitudinal perforation line 90. A longitudinal perforation line 112, parallel to lines 88 and 90, extends between perforation line 111 and transverse edge 74. Thus, a removable remittance document 114 is provided, defined by perforation lines 111, 112, a portion of fold line 90 and a portion of perforation line 92 within the front panel B, for easy separation therefrom by the addressee. The remittance document may be inserted into the return envelope as described below, and forwarded back to the original addressor, with, e.g., payment for an outstanding balance due, as indicated on the remittance document.

Front panel B is also provided with a die-cut window 116 permitting observation of address information preprinted on an insert sheet as described in further detail below. The window may, if desired, be covered by a plastic, transparent film strip 118 adhesively secured to the inside surface of the front panel B.

Rear panel A, as already pointed out above, includes removable tractor drive strip 82 (defined by perforation line 86 and longitudinal edge 78), and a portion of the removable transverse marginal edge strips 96, 98.

As best seen in FIG. 6, a horizontal line of perforations 120 extends between vertical lines 86 and 100, and parallel to the transverse line of perforations 94. A slit 122 extends parallel to line 86 between lines 94 and 120 and is located toward one end of the rear panel 92, adjacent vertical perforation line 86. This slit 122, along with horizontal perforation lines 94, 120 and a portion of vertical perforation line 100, define a removable tear strip 124, similar to tear strip 61 of the previously described embodiment. A solid reinforcing tab 126 may be applied to the strip 124 adjacent the slit 122 to facilitate gripping and removal of the strip. It will be appreciated that the tear strip could also be provided in the sheet 128, which would also facilitate opening of the return envelope.

With specific reference again to FIG. 5, a sheet 128 overlies the rear panel A and is defined by upper and lower, or transverse, edges 130, 132 and side or longitudinal edges 134, 136. Sheet 128 is die cut along the upper and lower transverse edges 130, 132 so that the latter overlie upper and lower transverse lines of perforations 92, 94, i.e., they do not extend to the transverse edges 74, 76. A tractor feed strip 138 defined by side edge 134 and an adjacent longitudinal line of perforations 140, overlies the tractor feed strip 82 of rear panel A. A longitudinal line of perforations 142 extends along and adjacent the edge 136 to define a removable strip 144. The sheet 128 is adhesively secured to the rear panel A by transverse adhesive lines 146, 148, and a vertical adhesive line (not shown) on the back side of the sheet 128, to the right of vertical perforation line 140. The sheet 128 is also adhesively secured to the rear panel A in the area where tractor strip 138 overlies tractor strip 82 by means of the adhesive lines 108 and 109 on the rear panel.

From the above, it will be appreciated that sheet 128 and rear panel A of the outgoing envelope also comprise the front and rear panels of the return envelope, edge 136 being unsecured to rear panel A to thereby define an opening for insertion of, e.g., the remittance document 114, and/or a check or the like into the return envelope.

A third sheet 154 having upper and lower or transverse edges 156, 158 and side or longitudinal edges 160, 162 fully overlies the sheet 128 and is substantially identical in size to the rear panel A. Sheet 154 is removably secured to the removable transverse marginal edge strips 96, 98 of the rear panel A via adhesive lines 164, 166 (which may comprise conventional glue spots) and to the tractor feed strip 138 of the intermediate sheet 128 via an adhesive line 168 provided on feed strip 138, although the adhesive could also be applied to the back side of sheet 154.

Sheet 154 is also provided with transverse perforation lines 170, 172 and a single vertical line of perforations 174 to form removable transverse marginal strips 176, 178 and removable tractor feed strip 180, respectively.

In its fully assembled and finished form, with panel B folded about line 90 to overlie panel A, the tractor feed strip 138 of sheet 128 is adhesively secured to rear panel A along the tractor feed strip 82, while the upper and lower edges of sheet 128 are adhesively secured to panel A adjacent the transverse marginal strips 96, 98; tractor feed strip 180 of sheet 154 is adhesively secured on its lower surface to sheet 128 along the tractor feed strip 138, and transverse marginal edge-strips 176, 178 of sheet 154 are adhesively secured on their lower surfaces to the rear panel A along transverse marginal strips 96, 98; and tractor drive strip 84 and those portions of transverse marginal edge strips 96, 98 which extend along front panel B are adhesively secured to sheet 154 along upper surfaces of tractor feed strip 180 and transverse marginal strips 176, 178.

In its finally assembled form, it will be appreciated that transverse perforation lines 92, 170 overlie each other so that transverse marginal strips 96 and 176 can be torn simultaneously from the form. Similarly, transverse perforation lines 94 and 172 overlie each other permitting a similar separation or removal of strips 98 and 178. At the same time, tractor drive strips 82, 138, 180 and 84 overlie each other, with perforation lines 86, 140, 174 and 88 in alignment, thereby permitting simultaneous separation of strips 82, 138 and 180 from the form.

In use, the addressee receiving the outgoing mailer is instructed to remove initially the transverse marginal strips 96, 176, 98 and 178, as well as tractor feed strips 82, 138, 180 and 84. Front panel B can then be unfolded and removed from rear panel A by tearing along the fold line 90. Thereafter, the remittance form 114 can be easily removed by separating along lines 90, 92, 111 and 112.

Sheet 154 may then also be easily removed since it is no longer adhesively secured to any other sheet, and it may be retained by the addressee as a customer receipt. Form 114 may then be inserted within the return envelope along with, e.g., a check, money order or the like. After removal of strip 144, a flap defined by perforation lines 90 and 100 is folded along line 100 and secured to sheet 128 via rewettable adhesive 110.

After the return envelope is received by the original addressor, the tear strip 124 may be pulled away from panel A along perforation line 120 and adhesive line 148 via tab 126, to thereby facilitate easy opening of the return envelope.

Figure 8:
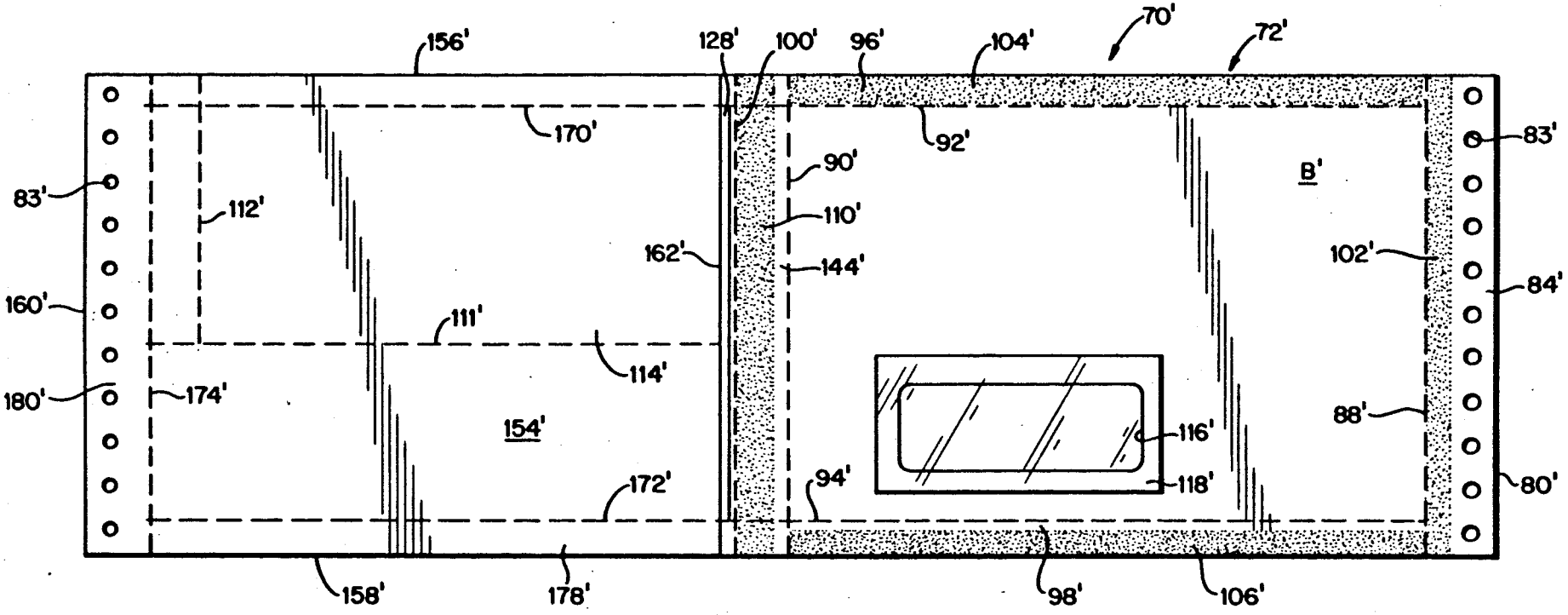
FIG. 8 is a top plan view of a sheet of an unfolded business form in accordance with another alternative embodiment of the invention.

Turning to FIG. 8, another embodiment is illustrated which is substantially identical to the embodiment illustrated in FIG. 5 with one significant exception. To facilitate easy understanding of this embodiment, similar reference numerals with a prime (') designation are used for corresponding elements. In this alternative arrangement, remittance form 114' has been incorporated into the insert sheet 154', while the front panel B' serves as the customer receipt. Accordingly, sheet 154' is provided with perforation lines 111' and 112' which cooperate with perforation line 170' and free edge 162' to define the remittance form 114'. It is this form which will be reinserted into the return envelope for return to the original addressor.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and products.

What is claimed is:

1. A mailer business form comprising:

an outgoing envelope comprising a first sheet folded along a fold line to form first and second panels each having three marginal edge portions, a return envelope comprising a second sheet overlying said second panel and adhesively secured to said second panel inwardly adjacent said three marginal edge portions such that said second panel forms a rear panel of both said outgoing envelope and said return envelope;

a slit formed in said second panel parallel to and adjacent one of said marginal edge portions, and a pair of parallel lines of perforations extending perpendicularly from opposite ends of said slit toward said fold line so as to provide an easily openable tear strip in said rear panel to facilitate access to the interior of the return envelope.

2. A mailer business form according to claim 1 wherein said three marginal edge portions of said first and second panels are each defined by a perforation line extending inwardly of, and parallel to, an associated edge of said first and second panels, said marginal edge portions being removable to provide access to the interior of the outgoing envelope.

3. A mailer business form according to claim 1 and further including a third removable sheet interposed between said first panel and said second sheet.

4. A mailer business form according to claim 3 wherein said first panel is provided with a window for viewing information printed on said third sheet.

5. A mailer business form according to claim 3 wherein said first panel is provided with an intermediate perforation line extending perpendicular to said fold line and about midway between two of said three marginal edge portions to thereby define a document removable from said first panel by a recipient of the outgoing envelope.

6. A mailer business form according to claim 3 wherein said first panel is adhesively secured along said three marginal edge portions to corresponding marginal edge portions of said third sheet.

7. A mailer business form according to claim 3 wherein said third sheet is provided with three marginal edge portions and wherein said third sheet is adhesively secured along two of said three marginal edge portions to corresponding marginal edge portions of said second panel.

8. A mailer business form according to claim 1 wherein a separable remittance document is incorporated into said first panel.

9. A mailer according to claim 3 wherein a separable remittance document is incorporated into said third sheet.

10. A mailer business form according to claim 1 wherein said, tear strip is reinforced adjacent said slit.

11. A mailer business form comprising:

an outgoing envelope comprising front and rear panels, each panel having first, second, third and fourth edges and first, second and third separable marginal edge portions, a fold line connecting said front and rear panels along said fourth edge, wherein said outgoing envelope is adapted to be opened by separation of said first, second and third marginal edge portions;

a second sheet at least partially overlying said rear panel, said second sheet being adhesively secured to said rear panel along three edges thereof to form with said rear panel a return envelope;

a separable third sheet interposed between said front panel and said second sheet; and a removable tear strip incorporated within one of said second sheet and said rear panel and adapted to enable opening of said return envelope.

12. A mailer according to claim 11 wherein said removable tear strip is incorporated in said rear panel and is defined, in part, by one of said separable marginal edge portions.

13. A mailer according to claim 11 wherein said tear strip is defined at one end thereof by a slit formed in said rear panel.

14. A mailer according to claim 11 wherein said third sheet is adhesively secured to said rear panel and said second sheet.

15. A mailer according to claim 14 wherein said front panel is adhesively secured to said third sheet.

16. A mailer according to claim 11 wherein a separable remittance document is incorporated within said front panel.

17. A mailer according to claim 11 wherein a separable remittance document is incorporated within said third sheet.

18. A mailer according to claim 11 wherein said front panel is provided with a window for viewing address information on said third sheet.

19. A mailer according to claim 11 wherein said tear strip lies inside of said separable marginal edge portions.

20. A mailer according to claim 15 wherein said tear strip lies inside of said separable marginal edge portions.

* * * * *